US009183792B2

(12) United States Patent
Henzen et al.

(10) Patent No.: US 9,183,792 B2
(45) Date of Patent: Nov. 10, 2015

(54) ELECTROPHORETIC DISPLAY

(75) Inventors: Alex Henzen, Bladel (NL); Daniel Wiermans, Sittard (NL); Patrick Janssen, Eindhoven (NL)

(73) Assignee: HJ FOREVER PATENTS B.V., Rotterdam (NL)

( * ) Notice: Subject to any disclaimer, the term of this patent is extended or adjusted under 35 U.S.C. 154(b) by 762 days.

(21) Appl. No.: 13/139,101

(22) PCT Filed: Dec. 9, 2009

(86) PCT No.: PCT/EP2009/066761
§ 371 (c)(1),
(2), (4) Date: Aug. 29, 2011

(87) PCT Pub. No.: WO2010/066806
PCT Pub. Date: Jun. 17, 2010

(65) Prior Publication Data

US 2011/0298838 A1 Dec. 8, 2011

(30) Foreign Application Priority Data

Dec. 11, 2008 (EP) ..... 08171366

(51) Int. Cl.
*G09G 3/34* (2006.01)

(52) U.S. Cl.
CPC ..... *G09G 3/344* (2013.01); *G09G 2300/08* (2013.01); *G09G 2300/0876* (2013.01); *G09G 2310/08* (2013.01)

(58) Field of Classification Search
USPC ..... 345/690, 107, 34; 315/169.1
See application file for complete search history.

(56) References Cited

U.S. PATENT DOCUMENTS 6,693,384 B1 * 2/2004 Vicentini et al. ..... 315/169.1
2005/0206585 A1 * 9/2005 Stewart et al. ..... 345/34

FOREIGN PATENT DOCUMENTS

WO WO 2007/004116 1/2007
WO WO 2008/054209 5/2008
WO WO 2008/054209 A1 * 5/2008

OTHER PUBLICATIONS

International Search Report for PCT/EP2009/066761, mailed Mar. 16, 2010.
Written Opinion of the international Searching Authority for PCT/EP2009/066761, mailed Mar. 16, 2010.

* cited by examiner

*Primary Examiner* — Quan-Zhen Wang
*Assistant Examiner* — Yuk Chow
(74) *Attorney, Agent, or Firm* — Nixon & Vanderhye P.C.

(57) ABSTRACT

A display apparatus comprises pixels (18) associated with intersections of select electrodes (17) and data electrodes (11) and having a bistable operation. A select driver (16) supplies select voltages (VG) to the select electrodes (17) to select a group of pixels (18). A data driver (10) supplies data voltages (VD) to the data electrodes (11) to supply the data voltages (VD) to the group of pixels (18) being selected. A common driver (25) supplies a backplane voltage (VB) to a common electrode (6) common for the group of pixels (18). A controller (15) controls the select driver (16), the data driver (10) and the common driver (25), in the order mentioned: (a) to change the select voltage (VG) to its on-level (on) at which the group of pixels (18) are selected, after the backplane voltage (VB) and the data voltage (VD) for the group of pixels (18) have a same first non-zero level (+15V), or before the backplane voltage (VB) and the data voltage (VD) for the group of pixels (18) are simultaneously changed to the same first non-zero level (+15V), (b) to change the data voltages (VD) in accordance with display data (13) defining an optical state of the individual pixels (18) of the group of pixels (18), (c) to change the select voltage (VG) to its off-level (off) at which the group of pixels (18) are not selected, (d) to change the select voltage (VG) to its on-level (on), after the backplane voltage (VB) and the data voltage (VD) for the group of pixels (18) have a same second non-zero level (−15V), or before the backplane voltage (VB) and the data voltage (VD) for the group of pixels (18) are simultaneously changed to the same second non-zero level (−15V), and (e) to change the data voltages (VD) in accordance with the display data (13).

4 Claims, 3 Drawing Sheets

VB
VD
VG
VP
+15V
0
-15V
+15V
0
-15V
on
off
+30V
+15V
0
-15V
-30V
t0
t1
t2
t3
t4
t5
t6
t7
t8
t9
t10
t11
t12
t13
t14
t15
t16
TS
TP1
TP2
TI VB
+15V
0
-15V
VD
+15V
0
-15V
VG
on
off
VP
+30V
+15V
0
-15V
-30V
TS
TP1
TI
TP2
t20
t21
t22
t23
t24
t25
t26
t27
t28
t29
t30
t31
t32
t33
t34
t35
t36
t37
t38

ELECTROPHORETIC DISPLAY

This application is the U.S. national phase of International Application No. PCT/EP2009/066761 filed 9 Dec. 2009, which designated the U.S. and claims priority to EP Application No. 08171366.1 filed 11 Dec. 2008, the entire contents of each of which are hereby incorporated by reference.

FIELD OF THE INVENTION

The invention relates to an electrophoretic display apparatus and to a method of driving a display device.

BACKGROUND OF THE INVENTION

A display device of the type mentioned in the opening paragraph is known from the international patent application US2006/0227196. This patent application discloses an electronic ink display which comprises two substrates. One of the substrates is transparent and is provided with a single electrode which is referred to as the counter electrode. This counter electrode is in other literature also referred to as common electrode or backplane electrode. The other substrate is provided with picture electrodes which comprise row and column electrodes. A display element or pixel is associated with an intersection of a row electrode and a column electrode. A pixel electrode of the display element is coupled to the column electrode via a thin film transistor (further referred to as TFT), the gate of which is coupled to the row electrode. This arrangement of display elements, TFT transistors and row and column electrodes together forms an active matrix. A row driver sequentially selects rows of display elements and the column driver supplies data signals to the selected row of display elements via the column electrodes and the TFT transistors. The data signals correspond to graphic data to be displayed.

An electronic ink is provided between the pixel electrode and the common electrode. The electronic ink comprises multiple microcapsules of about 10 to 50 microns. Each microcapsule comprises positively charged white particles and negative charge black particles suspended in a fluid. When a positive voltage is applied to the pixel electrode with respect to the common electrode, the positively charged white particles move to the side of the micro capsule directed to the transparent substrate on which the common electrode is present and a viewer will see a white display element. Simultaneously, the black particles move to the pixel electrode at the opposite side of the microcapsule where they are hidden to the viewer. By applying a negative voltage to the pixel electrode with respect to the common electrode, the black particles move to the common electrode at the side of the micro capsule directed to the transparent substrate and the display element appears dark to a viewer. When the voltage is removed, the display device remains in the acquired state and thus exhibits a bi-stable character. The electronic ink display with its black and white particles is particularly useful as an electronic book.

Grey scales are created in the display device by controlling the amount of particles that move to the common electrode at the top of the microcapsules. For example, the energy of the positive or negative electric field in the pixel caused by the voltage difference between the pixel and common electrodes, defined as the product of field strength and time of application, controls the amount of particles moving to the top of the microcapsules.

A multi-level drive of the pixel electrodes enables to more closely reach a desired light output of a pixel because it is possible to more accurately control the movement of the particles at a lower value of the drive voltage. However, such a multi-level drive of the pixel electrodes requires complex display drivers.

SUMMARY OF THE INVENTION

It is an object of the invention to provide an electrophoretic display which is able to drive the pixels with multi-level voltages without requiring complex display drivers.

A first aspect of the invention provides a display apparatus as claimed in claim 1. A second aspect of the invention provides a method of driving a display device as claimed in claim 4. Advantageous embodiments are defined in the dependent claims.

A display apparatus in accordance with the first aspect of the invention comprises pixels which are associated with intersections of select electrodes and data electrodes. The pixels have a bistable operation. For example, the pixels comprise electrophoretic material with charged particles.

A select driver supplies select voltages to the select electrodes to select a group of pixels associated with a particular or a particular group of select electrodes. A data driver supplies data voltages to the data electrodes. These data voltages are supplied to the group of pixels which are selected. Usually, the display comprises TFT's of which the conductivity is controlled by the select electrodes and which when conductive form a low impedance between the data electrodes and the pixel electrodes. A common driver supplies a backplane voltage to a common electrode which is common for the group of pixels. Thus, the voltage across the pixels is determined by the voltage difference between the pixel electrodes and the common electrode.

A controller controls the select driver, the data driver and the common driver to obtain the following order of drive voltages. The select voltage is changed to its on-level at which the group of pixels are selected, either after the backplane voltage and the data voltage for the group of pixels have a same first non-zero level, or before the backplane voltage and the data voltage for the group of pixels are simultaneously changed to the same first non-zero level. Then, the data voltages are changed in accordance with display data which defines an optical state of the individual pixels of the group of pixels. Only those data voltages of pixels which should change their optical state in accordance with the polarity of the voltage difference between the pixels electrodes and the common electrode should receive a pixel voltage which differs from the common voltage. Next, the select voltage is changed to its off-level at which the group of pixels is not selected. Now, the select voltage is changed to its on-level, either after the backplane voltage and the data voltage for the group of pixels have a second non-zero level, or before the backplane voltage and the data voltage for the group of pixels are simultaneously changed to the same second non-zero level. Then, the data voltages are changed in accordance with the display data. Only those data voltages of pixels which should change their optical state in accordance with the now opposite polarity of the voltage difference between the pixels electrodes and the common electrode should receive a pixel voltage which differs from the common voltage. Finally, the select voltage is changed to its off-level. It has to be noted that, due to their bistable behavior, the pixels keep their optical state after they are not anymore selected until they are selected again while the voltage across the pixel has changed.

In an embodiment, the pixels comprise a first type of charged electrophoretic particles with a first color and a second type of charged electrophoretic particles with a second color, wherein the second type of charged electrophoretic particles is oppositely charged with respect to the first type of charged electrophoretic particles.

In an embodiment, the controller changes the data voltages during the stage that the first non-zero level is supplied only for pixels of the selected group of pixels which should change their first color, and changes the data voltages during the stage that the second non-zero level is supplied only for pixels of the selected group of pixels which should change their second color.

These and other aspects of the invention are apparent from and will be elucidated with reference to the embodiments described hereinafter.

DETAILED DESCRIPTION

Figure 1:
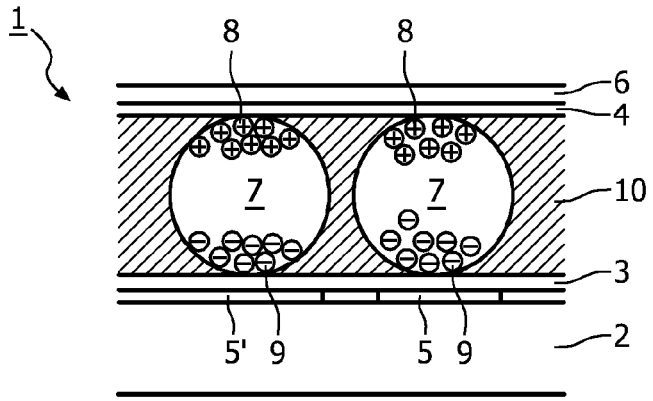
FIG. 1 shows diagrammatically a cross-section of a portion of an electrophoretic display device.

FIG. 1 diagrammatically shows a cross-section of a few display elements of an electrophoretic matrix display device 1. The display device 1 comprises a base substrate 2, an electrophoretic film with an electronic ink which is present between two transparent substrates 3 and 4 which, for example, are of polyethylene. The substrate 3 is provided with transparent picture electrodes 5, 5' and the other substrate 4 with a transparent common electrode 6. The electronic ink comprises multiple micro capsules 7, of about 10 to 50 microns. Each micro capsule 7 comprises positively charged white particles 8 and negatively charged black particles 9. The particles 8 and 9 are suspended in a fluid 40. The dashed material 41 is a polymeric binder. The layer 3 is not necessary and could alternatively be a glue layer. When a negative voltage is applied to the common electrode 6 with respect to the picture electrodes 5, an electric field is generated which moves the white particles 8 to the side of the micro capsule 7 directed to the common electrode 6 and the display element will appear white to a viewer. Simultaneously, the black particles 9 move to the opposite side of the microcapsule 7 where they are hidden to the viewer. By applying a positive field between the common electrode 6 and the picture electrodes 5, the black particles 9 move to the side of the micro capsule 7 directed to the common electrode 6 and the display element will appear dark to a viewer (not shown). When the electric field is removed the particles 7 remain in the acquired state and the display exhibits a bi-stable character and consumes substantially no power.

Figure 2:
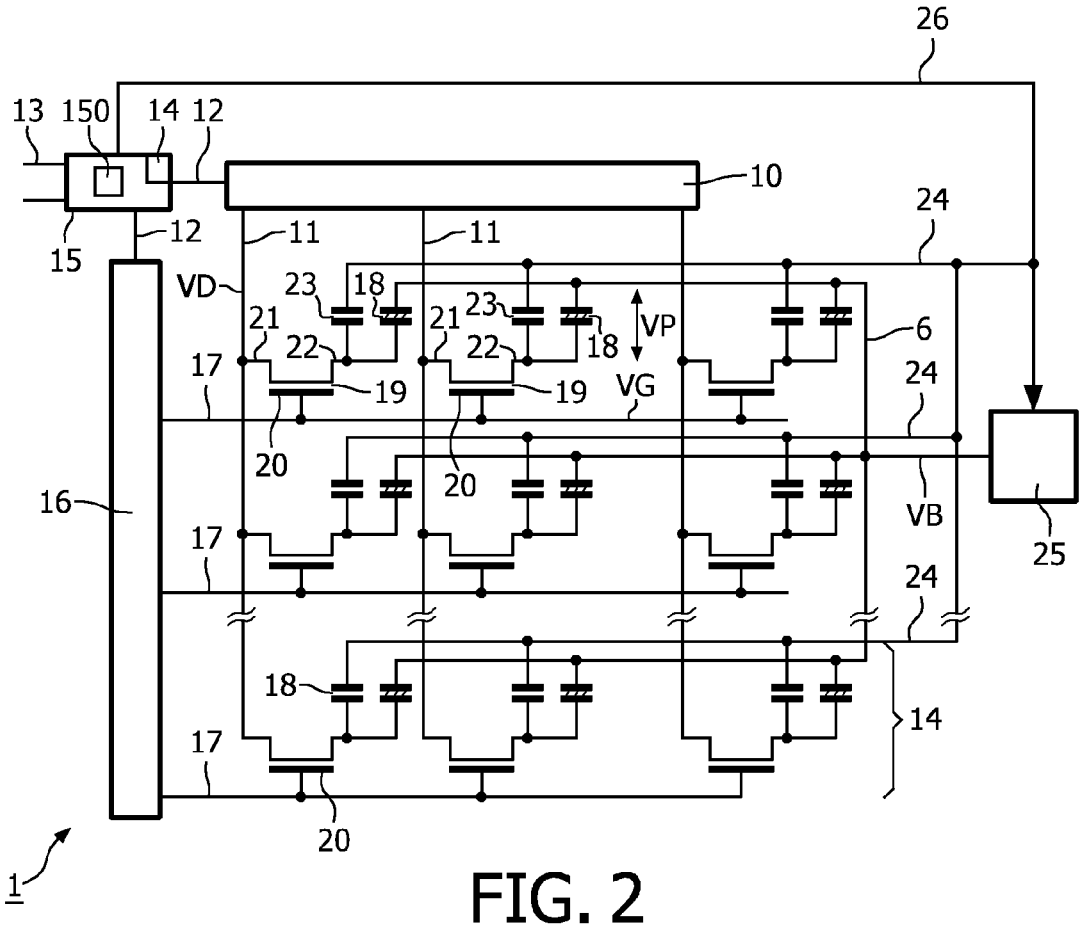
FIG. 2 shows diagrammatically an equivalent circuit diagram of a portion of the electrophoretic display device.

FIG. 2 shows diagrammatically an equivalent circuit of the matrix display device 1 which comprises an electrophoretic film laminated on the base substrate 2 provided with active switching elements 19, a row driver 16 and a column driver 10. Preferably, the common electrode 6 is provided on the film comprising the encapsulated electrophoretic ink. Alternatively, the common electrode 6 could be provided on a base substrate if the operation of the display is based on in-plane electric fields. The display device 1 is driven by active switching elements, for example, thin film transistors 19. The display device 1 comprises a matrix of display elements at the area of intersecting row or select electrodes 17 and column or data electrodes 11. The row driver 16 consecutively selects the row electrodes 17, while a column driver 10 provides data signals to the column electrodes 11 for the selected row electrode 17. Preferably, a processor 15 firstly processes incoming data 13 into the data signals to be supplied by the column electrodes 11.

The drive lines 12 carry signals which control the mutual synchronisation between the column driver 10 and the row driver 16. Select signals VG from the row driver 16 which are electrically connected to the row electrodes 17 select the pixel electrodes 22 via the gate electrodes 20 of the thin film transistors 19. The source electrodes 21 of the thin film transistors 19 are electrically connected to the column electrodes 11. A data signal VD present at the column electrode 11 is transferred to the pixel electrode 22 of the display element 18 (also referred to as pixel) coupled to the drain electrode of the TFT if the associated TFT is conductive. In the embodiment shown, the display device of FIG. 1 further comprises an additional capacitor 23 at the location of each display element 18. This additional capacitor 23 is connected between the pixel electrodes 22 of the associated pixel 18 and one or more storage capacitor lines 24. Instead of a TFT other switching elements can be applied such as diodes, MIM's, etc.

In contrast to what is common practice in electrophoretic displays, the common electrode 6 receives the voltage VB from a backplane driver 25 instead of being switched between ground potential and a fixed common voltage. In accordance with the present invention, during an image update, the backplane driver 25 supplies a sequence of voltages comprising non-zero voltages. The column driver 10 and the row driver 16 may be commonly used drivers. The processor 15 provides control signals 26 to the backplane driver 25 to coordinate the operation of the backplane driver 25 with the column driver 10 and the row driver 16.

If applicable, the processor 15 may comprise a memory 150 for storing previous drive voltages of the pixels 18 required for a transition drive scheme. Alternatively, the memory 150 may be used to store the levels of the correction pulses required for each optical state.

Figures 3A, 3B, 3C, 3D:
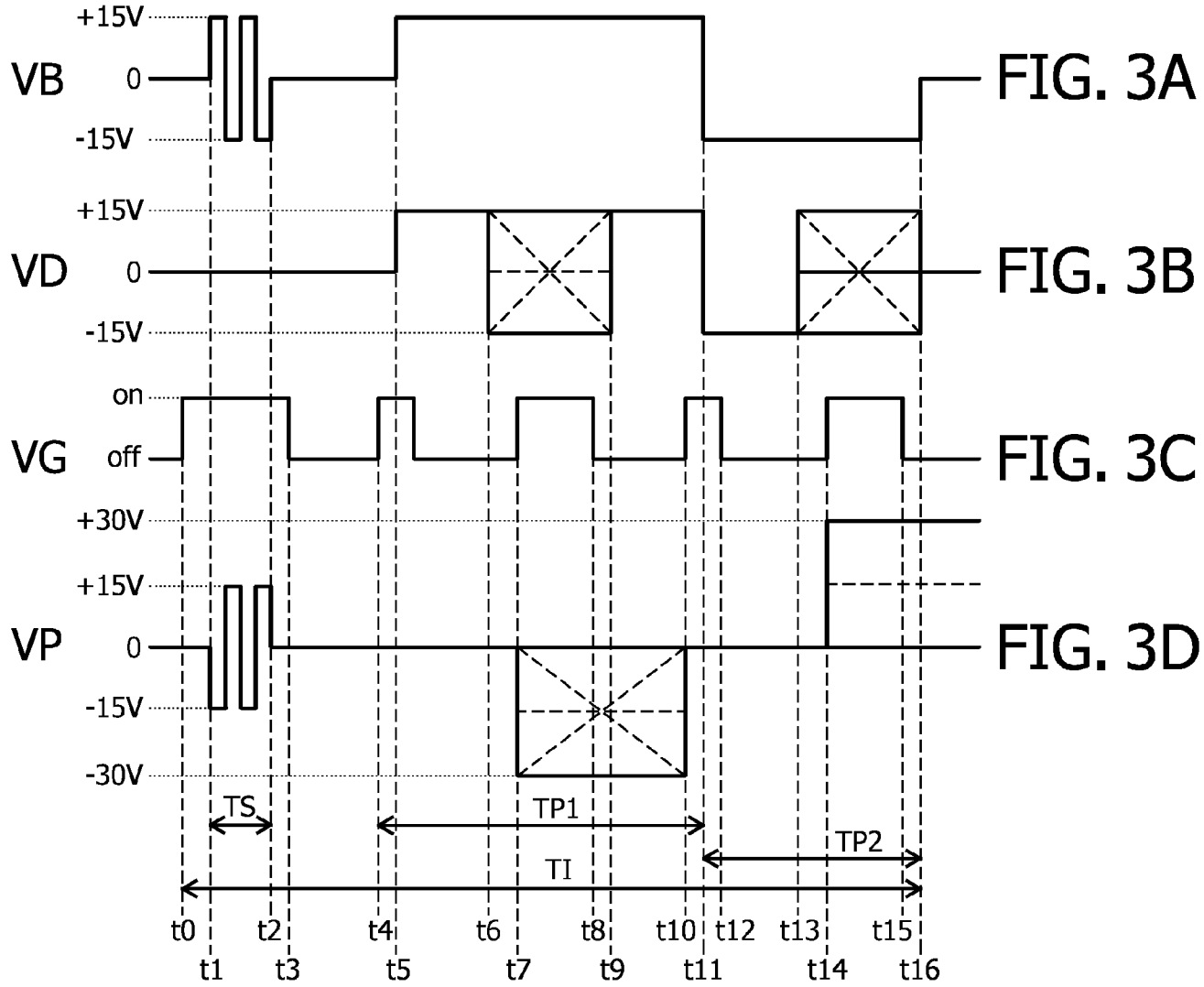
FIGS. 3A to 3D show diagrammatically signals elucidating the operation of an embodiment of the invention.

FIGS. 3A to 3D show diagrammatically signals elucidating the operation of an embodiment of the invention. FIG. 3B shows the data voltage VD on a data electrode. FIG. 3A shows the voltage VB on the common electrode 6. FIG. 3C shows the select voltage VG on a select electrode 17. FIG. 3D shows the pixel voltage VP across a pixel 18.

In the example shown in FIG. 3, the row image update cycle TI for one row of pixels 18 comprises an optional shaking period TS, a period in time TP1 during which the pixel voltage VP has a first polarity (negative in the example shown) and a period in time TP2 during which the pixel voltage VP has a second polarity opposite to the first polarity (positive in the example shown). The order of the period in times TP1 and TP2 may be interchanged in that first the positive polarity voltage VP is supplied. Instead of one row of pixels, a group of rows of pixels may be updated with the same data during the same row image update cycle TI. The total image update cycle comprises a number of row image update cycles TI such that during the total image update cycle all pixel data is updated and a new image can be displayed. Thus, the row image update period TI is defined as the period in time during which a sequence of voltages is applied across the pixels 18 of the selected row (or rows if multiple rows are selected during the same select period) such that after the row update period TI the new image data is displayed in the selected group of pixels 18.

During the optional shaking period TS, the backplane driver 25 supplies a backplane voltage VB which comprises a sequence of voltage levels having opposite polarity. At the instant t0, the backplane voltage VB and the data voltage VD are zero, the gate voltage VG has for all select electrodes 17 its on-level such that all the TFT's are conductive, and consequently, the pixel voltage VP is zero. Between the instants t1 and t2, the backplane voltage VB alternatively has the levels +15V and −15V and thus the pixel voltage VP alternatively has the levels −15V and +15V. At the end of the shaking period TS, at the instant t2, the backplane voltage VB returns to its zero level, the gate voltage VG returns to its off-level at which the FET's of the group of pixels are switched off and the pixel voltage VP returns to zero volts. A shaking phase as such and its positive effect on reproducibility of the grey levels are known from US2006/0227196.

During the period of time TP1 which lasts from the instant t4 to t10, first at the instant t4 all pixels 18 are selected by changing the gate voltage VG to its on-level at which the FET's of the group of pixels 18 are conductive. At the instant t5, the backplane voltage VB is changed to its positive level of +15V and simultaneously all the data voltages VD of the group of pixels 18 are changed to the same level as the backplane voltage VB. Consequently, the pixel voltage VP remains zero and the optical state of the pixels 18 does not change. Alternatively, the backplane voltage VB and the data voltages VD may be changed simultaneously or non-simultaneously before the instant t4, as will be elucidated with respect to FIGS. 4A to 4B.

At the instant t6, the data voltages VD are changed to the level required for the optical state transition of the individual pixels 18 of the group of pixels which are selected. For pixels 18 which should not change their optical state towards the direction associated with the backplane voltage VB being positive with respect to the pixel voltage VP (which in this example is towards black because the negatively charged black particles are attracted towards the common electrode) should receive the high level data voltage VD which is identical to the positive level of the backplane voltage VB. These pixels will keep their optical state because the pixel voltage VP across them is kept zero. For pixels 18 which should change their optical state towards black, the data voltage VD should be changed to zero or to the negative level of −15V dependent on how much the optical state should change. The gate voltage VG may be switched to the off-level before the data voltages VD are changed and than has to be switched to the on-level once the data voltages VD have settled. This has the advantage that disturbances due to the settling of the data voltages VD are prevented.

At the instant t7, after the data voltages VD have settled, the gate voltage VG is switched to its on-level and the data voltages VD are supplied to the associated pixels 18. The gate voltage VG is switched to its off-level at the instant t8. At the instant t9, the data voltages VB are changed back to the same level as the backplane voltage VB. This has no influence on the pixel voltage VP because the FET's are non-conductive. Thus, the pixel voltages VP of the pixels 18 are kept unaltered until a next change in the optical state is required.

During the period of time TP2 which lasts from the instant t10 to t16, first at the instant t10 all pixels 18 are selected by changing the gate voltage VG to its on-level at which the FET's are conductive. At the instant t11, the backplane voltage VB is changed to its negative level of −15V and simultaneously all the data voltages VD of the selected pixels 18 are changed to the same level as the backplane voltage VB. Consequently, at the instant t10, the pixel voltage VP becomes zero. The amount of change of the optical state of the pixels 18 depends on the non-zero voltage across the pixels 18 and the duration of the period in time lasting from the instant t7 to t10. Alternatively, the backplane voltage VB and the data voltage VD may be changed simultaneously or non-simultaneously between the instants t9 and t10 or between the instants t12 and t13 as will be elucidated with respect to FIGS. 4A to 4D.

At the instant t13, the data voltages VD are changed to the level required for the optical state transition of the individual pixels 18. For pixels 18 which should not change their optical state towards the direction associated with the backplane voltage VB being negative with respect to the pixel voltage VP (which in this example is towards white because the positively charged white particles are attracted towards the common electrode) should receive the low level data voltage VD which is identical to the negative level of the backplane voltage VB. These pixels will keep their optical state because the pixel voltage VP across them is kept zero. For pixels 18 which should change their optical state towards white the data voltage VD should be changed to zero or to the positive level of +15V dependent on how much the optical state should change. Again, the gate voltage VG may be switched to the off-level before the data voltages VD are changed and than has to be switched to the on-level once the data voltages VD have settled.

At the instant t14, after the data voltages VD have settled, the gate voltage VG is switched to its on-level and the data voltages VD are supplied to the associated pixels 18. The gate voltage VG is switched to its off-level at the instant t15. The amount of change of the optical state of the pixels 18 depends on the value of the non-zero voltage across the pixels 18 and the duration of the period in time lasting from the instant t14 to the instant after the instant t16 at which the gate voltage VG switches to the on level. At the instant t16, the data voltages VD are changed back to the same level as the backplane voltage VB. This level of the backplane voltage VB may be zero volts (as shown) if the row update period ends and the next row update period has to start with shaking pulses. Alternatively, the backplane voltage VB may change to another non-zero level if a further change of the optical state of pixels 18 is required. For example, the sequence of the periods TP1 and TP2 may be repeated but now with other levels of the backplane voltage VB. For example, during the period TP1 the backplane voltage may be +7.5 V and the during the period TP2 the backplane voltage VB may be −7.5 V. Such a sequential variation of the backplane voltage VB enables a very accurate reproduction of grey levels (or colors in a color display). The selection of the levels of the backplane voltages must not be symmetric and may be selected freely to optimally fit a particular display. The change of the data voltages VD at the instant t16 has no influence on the pixel voltage VP because the FET's are non-conductive. Thus, the pixel voltages VP of the pixels 18 is kept unaltered until a change of the optical state is required.

It has to be noted that the column driver 10 and the row driver 16 can be commonly used three level drivers which supply a positive level, a negative level or zero volts. The backplane driver 25 may be a similar three level driver. Alternatively, the backplane driver 25 may be a much more complex driver which can produce many levels. Such a backplane driver 25 may be based on a D/A converter. The high complexity of the backplane driver 25 is not a very relevant issue because only one such driver is required for driving the common electrode. Even if the common electrode is divided in a few separate common electrodes, for example each one associated with a different group of adjacent rows of pixels 18, only a few backplane drivers 25 are required.

In an analog implementation, the backplane driver 25 may comprise a sample and hold circuit which supplies a drive signal to two anti-parallel arranged buffers to obtain the common voltage. In a digital implementation, the backplane driver 25 may comprises a microprocessor which generates the common voltage via a DAC and a buffer. The common voltage may be sensed by the microprocessor with an ADC.

For the ease of understanding, the influence of the kickback effect is neglected in the above discussed example. For displays in which the kickback effect is present, usually the common electrode voltage has an offset for compensating for the kickback effect. For example if a +2V offset voltage would be required, the +7.5V level has to be replaced by 9.5V and the −7.5V level should be replaced by −5.5V. The kickback effect is caused by the change from the gate voltage VG from the on-level to the off-level which increases the pixel voltage VP via the gate source capacitance of the FET 19.

Figures 4A, 4B, 4C, 4D:
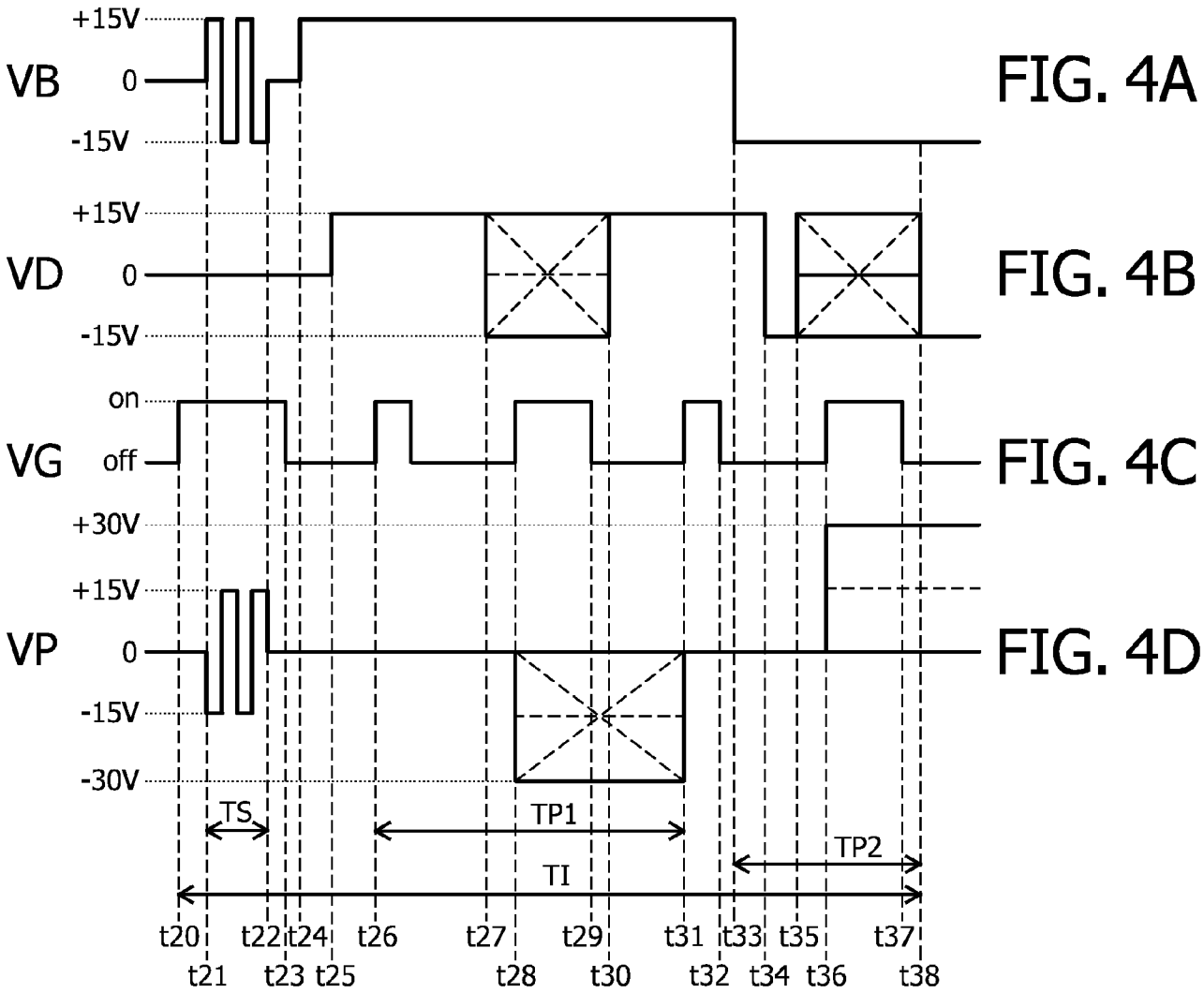
FIGS. 4A to 4D show diagrammatically signals elucidating the operation of an embodiment of the invention.

FIGS. 4A to 4D show diagrammatically signals elucidating the operation of an embodiment of the invention. FIG. 4B shows the data voltage VD on a data electrode. FIG. 4A shows the voltage VB on the common electrode 6. FIG. 4C shows the select voltage VG on a select electrode 17. FIG. 4D shows the pixel voltage VP across a pixel 18.

In the example shown in FIG. 4, the row image update cycle TI for one row of pixels 18 comprises an optional shaking period TS, a period in time TP1 during which the pixel voltage VP has a first polarity (negative in the example shown) and a period in time TP2 during which the pixel voltage VP has a second polarity opposite to the first polarity (positive in the example shown). Again, the order of the period in times TP1 and TP2 may be interchanged in that first the positive polarity voltage VP is supplied. Instead of one row of pixels, a group of rows of pixels may be updated with the same data during the same row image update cycle TI.

The optional shaking period TS is identical to that described with respect to FIGS. 3A to 3D.

During the period of time TP1 which lasts from the instant t26 to t31, first at the instant t24, the backplane voltage VB is changed to its positive level of +15V. Because the gate voltage VG has the off level, the associated FET's 20 have a very high impedance. Thus, the voltage at the junctions 22 of the respective FET's 20 and pixel capacitances 18 will rise together with the rise of the backplane voltage VB. At the instant t25 all the data voltages VD of the group of pixels 18 are changed to the same level as the backplane voltage VB. Now, at instant t26, the gate voltage VG may be changed to its on-level at which the FET's of the group of pixels 18 are conductive. Due to the fact that the backplane voltage VB and the data voltages VD are identical, the pixel voltage VP remains zero and the optical state of the pixels 18 does not change. Alternatively, in the time period between the instants t23 and t26, first the data voltages VD may be changed and than the backplane voltage VB.

At the instant t27, the data voltages VD are changed to the level required for the optical state transition of the individual pixels 18 of the group of pixels which are selected. For pixels 18 which should not change their optical state towards the direction associated with the backplane voltage VB being positive with respect to the pixel voltage VP should receive the high level data voltage VD which is identical to the positive level of the backplane voltage VB. These pixels will keep their optical state because the pixel voltage VP across them is kept zero. For pixels 18 which should change their optical state towards black, the data voltage VD should be changed to zero or to the negative level of −15V dependent on how much the optical state should change. The gate voltage VG may be switched to the off-level before the data voltages VD are changed and than has to be switched to the on-level once the data voltages VD have settled. This has the advantage that disturbances due to the settling of the data voltages VD are prevented. Alternatively, the gate voltage may have the on level from instant t26 to instant t28 or may have the off level from the instant t23 to the instant t28.

In the embodiment shown, at the instant t28, after the data voltages VD have settled, the gate voltage VG is switched to its on-level and the data voltages VD are supplied to the associated pixels 18. The gate voltage VG is switched to its off-level at the instant t29. At the instant t30, the data voltages VB are changed back to the same level as the backplane voltage VB. This has no influence on the pixel voltage VP because the FET's 20 are non-conductive. At the instant t31 the gate voltage VG is changed to the on level and the pixel voltage VP becomes zero. The amount of change of the optical state of the pixels 18 depends on the non-zero voltage across the pixels 18 and the duration of the period in time lasting from the instant t28 to the instant t31. Now the pixel voltage VP is zero, the optical state of the pixels 18 is kept unaltered until a next change in the optical state is required.

During the period of time TP2 which lasts from the instant t33 to the instant t38, first at the instant t33 the backplane voltage VB is changed to its negative level of −15V, than at the instant t34 all the data voltages VD of the selected pixels 18 are changed to the same level as the backplane voltage VB. Consequently, the pixel voltage VP remains zero. Alternatively, first the data voltages VD and than the backplane voltage VB may be changed simultaneously or non-simultaneously between the instants t32 and t35.

At the instant t35, the data voltages VD are changed to the level required for the optical state transition of the individual pixels 18. For pixels 18 which should not change their optical state towards the direction associated with the backplane voltage VB being negative with respect to the pixel voltage VP should receive the low level data voltage VD which is identical to the negative level of the backplane voltage VB. These pixels will keep their optical state because the pixel voltage VP across them is kept zero. For pixels 18 which should change their optical state towards white the data voltage VD should be changed to zero or to the positive level of +15V dependent on how much the optical state should change. Again, the gate voltage VG may be switched to the off-level before the data voltages VD are changed and than has to be switched to the on-level once the data voltages VD have settled.

At the instant t36, after the data voltages VD have settled, the gate voltage VG is switched to its on-level and the data voltages VD are supplied to the associated pixels 18. The gate voltage VG is switched to its off-level at the instant t37. The amount of change of the optical state of the pixels 18 depends on the value of the non-zero voltage across the pixels 18 and the duration of the period in time lasting from the instant t36 to the instant the gate voltage is switched to its on level while the data voltages VD are equal to the backplane voltage VB. This level of the backplane voltage VB may be zero volts if the row update period ends and the next row update period has to start with shaking pulses. Alternatively, the backplane voltage VB may have another non-zero level if a further change of the optical state of pixels 18 is required. For example, the sequence of the periods TP1 and TP2 may be repeated but now with other levels of the backplane voltage VB. For example, during the period TP1 the backplane voltage may be +7.5 V and the during the period TP2 the backplane voltage VB may be −7.5 V. Such a sequential variation of the backplane voltage VB enables a very accurate reproduction of grey levels (or colors in a color display). The selection of the levels of the backplane voltages must not be symmetric and may be selected freely to optimally fit a particular display. The change of the data voltages VD at the instant t38 has no influence on the pixel voltage VP because the FET's are non-conductive.

It should be noted that items which have the same reference numbers in different Figures, have the same structural features and the same functions, or are the same signals. Where the function and/or structure of such an item has been explained, there is no necessity for repeated explanation thereof in the detailed description.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A display apparatus comprising:

Pixels associated with intersections of select electrodes and data electrodes and having a bistable operation, a select driver for supplying select voltages to the select electrodes or selecting a group of pixels, a data driver for supplying data voltages to the data electrodes for supplying the data voltages to the group of pixels being selected, a common driver for supplying a backplane voltage to a common electrode common for the group of pixels, and a controller for controlling the select driver, the data driver and the common driver, in the order mentioned:

(a) to change the select voltage to its on-level at which the group of pixels are selected before the backplane voltage and the data voltage for the group of pixels are simultaneously changed to a same first non-zero level, (b) to simultaneously change the backplane voltage and the data voltage for the group of pixels to the same first non-zero level, (c) to change the data voltages in accordance with display data defining an optical state of the individual pixels of the group of pixels, (d) to change the select voltage to its off-level at which the group of pixels are not selected, (e) to change the select voltage to its on-level before the backplane voltage and the data voltage for the group of pixels are simultaneously changed to a same second non-zero level, (f) to simultaneously change the backplane voltage and the data voltage for the group of pixels to the same second non-zero level, and (g) to change the data voltages in accordance with the display data.

2. A display apparatus as claimed in claim 1, wherein the pixels comprise a first type of charged electrophoretic particles with a first color and a second type of charged electrophoretic particles with a second color, wherein the second type of charged electrophoretic particles is oppositely charged with respect to the first type of charged electrophoretic particles.

3. A display apparatus as claimed in claim 2, wherein controller is constructed for changing the data voltages during stage (b) only for pixels of the group of pixels which should change their first color, and for changing the data voltages during stage (e) only for pixels of the group of pixels which should change their second color.

4. A method of driving a display device comprising pixels associated with intersections of select electrodes and data electrodes and having a bistable operation, the method comprises:

supplying select voltages to the select electrodes for selecting a group of pixels, supplying data voltages to the data electrodes for supplying the data voltages to the group of pixels being selected, supplying a backplane voltage to a common electrode common for the group of pixels, and controlling the select driver, the data driver and the common driver, in the order mentioned:

(a) to change the select voltage to its on-level at which the group of pixels are selected before the backplane voltage and the data voltage for the group of pixels are simultaneously changed to a same first non-zero level, (b) to simultaneously change the backplane voltage and the data voltage for the group of pixels to the same first non-zero level, (c) to change the data voltages in accordance with display data defining an optical state of the individual pixels of the group of pixels, (d) to change the select voltage to its off-level at which the group of pixels are not selected, (e) to change the select voltage to its on-level before the backplane voltage and the data voltage for the group of pixels are simultaneously changed to a same second non-zero level, (f) to simultaneously change the backplane voltage and the data voltage for the group of pixels to the same second non-zero level, and (g) to change the data voltages in accordance with the display data.

* * * * *